US009573655B1

(12) United States Patent
Pigeon

(10) Patent No.: US 9,573,655 B1
(45) Date of Patent: Feb. 21, 2017

(54) BOAT AND IMPROVED WAKE-MODIFYING DEVICE FOR MANIPULATING THE SIZE AND SHAPE OF THE WAKE

(71) Applicant: Charles Frank Pigeon, Austin, TX (US)

(72) Inventor: Charles Frank Pigeon, Austin, TX (US)

(73) Assignee: Tige Boats, Inc., Abilene, TX (US)

( * ) Notice: Subject to any disclaimer, the term of this patent is extended or adjusted under 35 U.S.C. 154(b) by 0 days.

(21) Appl. No.: 15/179,136

(22) Filed: Jun. 10, 2016

Related U.S. Application Data

(60) Provisional application No. 62/173,724, filed on Jun. 10, 2015.

(51) Int. Cl.
*B63B 1/22* (2006.01)
*B63B 35/85* (2006.01)
*B63B 1/20* (2006.01)

(52) U.S. Cl.
CPC . *B63B 1/20* (2013.01); *B63B 1/22* (2013.01); *B63B 35/85* (2013.01); *B63B 2035/855* (2013.01)

(58) Field of Classification Search
CPC ..... B63B 1/20; B63B 1/22; B63B 35/85
USPC ..... 114/285
See application file for complete search history.

(56) References Cited

U.S. PATENT DOCUMENTS

| | | | | |
|---|---|---|---|---|
| 3,399,643 | A * | 9/1968 | Bennett | B63B 39/061 114/285 |
| 8,833,286 | B1 * | 9/2014 | Sheedy | B63B 1/26 114/285 |
| 9,067,644 | B2 | 6/2015 | Sheedy et al. | |
| 9,174,703 | B2 | 11/2015 | Sheedy et al. | |
| 9,315,235 | B1 * | 4/2016 | Wood | B63B 1/22 |
| 9,446,823 | B2 * | 9/2016 | Sheedy | B63B 1/26 |
| 2015/0101523 | A1 | 4/2015 | Sheedy et al. | |
| 2015/0158554 | A1 | 6/2015 | Sheedy et al. | |
| 2015/0175242 | A1 * | 6/2015 | Sheedy | B63B 35/85 114/285 |
| 2016/0039501 | A1 | 2/2016 | Sheedy et al. | |
| 2016/0075416 | A1 | 3/2016 | Sheedy et al. | |

* cited by examiner

*Primary Examiner* — Lars A Olson
*Assistant Examiner* — Jovon Hayes
(74) *Attorney, Agent, or Firm* — Egan, Peterman, Enders & Huston, LLP.

(57) ABSTRACT

Various configurations of improved wake-modifying devices for a power boat are provided herein. All such configurations provide a water channel and (optional) wedge for capturing and redirecting significantly more of the water flowing past the transom of the boat than conventional trim tabs consisting primarily of a flat plate. This increases the upward force applied to the deployed wake-modifying device and raises the stern of the boat on the non-surf side to list the boat to the surf side, producing a larger wake on the surf side. Some configurations provide a convergent water channel to produce longer, smoother wakes on the surf side of the boat. Other configurations provide a divergent water channel, which produces a comparatively shorter, taller wake on the surf side of the boat.

23 Claims, 8 Drawing Sheets

BOAT AND IMPROVED WAKE-MODIFYING DEVICE FOR MANIPULATING THE SIZE AND SHAPE OF THE WAKE

PRIORITY CLAIM

The present application claims priority to U.S. Provisional Application No. 62/173,724 filed Jun. 10, 2015.

BACKGROUND OF THE INVENTION

1. Field of the Invention

This invention generally relates to boats and, more specifically, to wake-modifying devices for boats.

2. Description of the Related Art

The following descriptions and examples are not admitted to be prior art by virtue of their inclusion within this section.

Various types of power boats have been used for towing people for water sports, including those powered by outboard motors and inboard motors. Embodiments of a conventional power boat 10 having an inboard motor are shown in FIGS. 1-3 as having a hull 12, which extends along a longitudinal axis 14 of the boat from a bow 16 to a stern 18, and which extends outward from a center line 20 of the boat to a port side 22 and a starboard side 24. As described in more detail below, a center trim plate 26 is often pivotably mounted to the transom 28 at the center line 20 to adjust the trim of the boat.

Many power boats are designed to tow people with a specific water sport in mind, such as but not limited to water skiing, knee-boarding, wake boarding and wake surfing. The size and shape of desirable wakes varies for each sport and is also dependent on the skill and preference of the person performing the sport. For instance, it is often desirable to water ski and knee board on relatively flat wakes, whereas relatively larger wakes are generally desirable for wake boarding and wake surfing. Given such variances on desirable sizes and shapes of wakes for different water sports and preferences, achieving differing and optimal wake size and shape for each sport and skill-type on a given boat is very difficult.

For example, some power boats may be designed for producing relatively large wakes, and thus, may have a hull 12 with a deep V-shaped cross-section, as shown in FIG. 2. A hull with a deep V-shaped cross-section is described herein as exhibiting a deadrise angle (i.e., the angle $\alpha$ measured between the bottom surface of the hull and the horizontal from a point along the center line 20 to the port 22 or starboard 24 side) between approximately 15° and 45°. In some boats, the hull 12 may have a substantially consistent deadrise angle from the bow 16 to the stern 18. In other boats, the deadrise angle may gradually taper along the longitudinal axis 14 of the boat so as to produce a flat or semi-flat deadrise at the stern of the boat. In this type of power boat, it is desirable to get the front end of the hull 12 out of the water at a higher angle of attack as the boat accelerates to cut down on drag and allow the boat to go much faster. This causes the stern 18 of the boat to sit down lower into the water so that it effectively digs a trench along the path that it makes in the water, which in turn produces bigger wakes. For this reason, this type of boat is generally well-suited for water sports that benefit from large wakes, such as wake boarding and wake surfing.

To produce the relatively smaller wakes desirable for water skiing, a center trim plate 26 is often coupled to the transom 28 at the center line 20. The center trim plate 26 typically consists of a flat, substantially rectangular plate, and is typically coupled to the transom 28 via a hinge 30 and linear actuator 32, which moves the center trim plate 26 from a non-deployed position (out of the water) to a deployed position (into the water). As the boat moves through the water, the water flowing under the boat impinges on the deployed trim plate 26, creating an upward force on the trim plate which, in turn, raises the stern 18 to help plane the boat faster. When used for water skiing, the center trim plate 26 may be deployed to raise the stern 18 of the boat and minimize the wake.

In other types of power boats (FIGS. 1 and 3), the hull 12 may have a more shallow V-shape at the bow 16 that quickly merges into a flat or semi-flat bottom amidship and continues to the stern 18. A hull with a semi-flat bottom surface at the stern is described herein as having a deadrise angle (a) that ranges between approximately 5° and 12°. This flatter hull design runs with substantially greater surface area along the top of the water, and thus, produces higher drag. When run at speed, the flatter hull design does not lift with the high angle of attack characteristic of deep V-shaped hull boats, and thus, produces smaller wakes desired for water skiing. However, boats with these hull designs are generally unsuitable for wake boarding and wake surfing without further including some form of wake-modifying device.

The substantially flatter hull design shown in FIG. 3 also benefits from a center trim plate 26, which is coupled to the transom 28 at the center line 20 and made pivotable from a non-deployed position to a deployed position. As noted above, the center trim plate 26 is typically a flat, substantially rectangular plate. When the center trim plate 26 is actuated into the deployed position, the stern 18 of the boat is raised to produce smaller wakes desirable for water skiing. However, the substantially flatter hull design shown in FIG. 3 is generally unable to produce the larger wakes desired for wake boarding and wake surfing without utilizing some form of wake-modifying device. In order to produce larger wakes, additional trim tabs 34 and 36 are often mounted onto the transom 28; one on the port side and one on the starboard side of the center line 20. Similar to center trim plate 26, the port and starboard trim tabs 34 and 36 typically consist of a flat plate having one or more down-turned edges and/or one or more up-turned edges. In the example shown in FIG. 3, the port and starboard trim tabs 34 and 36 each comprise a trailing edge (i.e., the edge of the plate furthest from the transom) bent downward at some angle, and an outboard edge bent upward at some angle. When the port trim tab 34 is deployed to raise the port side of the boat, an increase in displacement on the starboard side of the boat increases the size of the starboard wake. Conversely, the starboard trim tab 36 may be deployed to increase the size of the port wake.

Even with the trim tabs described above, wake boarders and wake surfers desire larger wakes with improved wave shapes. For surfing in particular, wake surfers desire a wake with a large surfable area that extends substantially from the swim platform to the curl of the wake. As such, it is desirable to provide improved port and starboard trim tab designs (i.e., wake-modifying devices), which provide even greater wake shaping ability than is currently possible with conventional trim tab designs.

SUMMARY OF THE INVENTION

The following description of various embodiments of boats and wake-modifying devices is not to be construed in any way as limiting the subject matter of the appended claims.

Embodiments of wake-modifying devices are provided herein for manipulating the size and/or shape of the wake (or wave) produced by a power boat, particularly by channeling significantly more water to the non-surf side of the boat, so that constructive interference of waves converging behind the boat form a substantially larger, smoother wake on the surf-side of the boat. A boat is also provided herein comprising a hull having a port side, a starboard side and a transom, and a pair of wake-modifying devices. The pair of wake-modifying devices may be coupled to the transom of the boat, one near the port side and one near the starboard side. As such, the wake-modifying device described herein may be a port side wake-modifying device or a starboard side wake-modifying device.

In general, each wake-modifying device may include a hinge, a water channel and a linear actuator. The hinge is configured to provide a pivot axis about which the wake-modifying device is rotated between a deployed position and a non-deployed position. The water channel is configured to redirect water flowing past the transom out through an outboard side of the water channel when the wake-modifying device is rotated to the deployed position. The linear actuator is coupled between the transom and the wake-modifying device for moving the wake-modifying device from the non-deployed position and the deployed position, and vice versa.

Unlike conventional port and starboard trim tabs, which consist primarily of a flat plate, the wake-modifying device described herein provides a water channel, which is configured to capture and redirect significantly more of the water flowing past the transom to the outboard side of the boat. The "water channel" described herein is a concave structure having downwardly curved or inclined forward end and trailing end portions. The "forward end portion" refers to the longitudinal portion of the water channel closest to the transom of the boat, and the "trailing end portion" refers to the longitudinal portion of the water channel farthest from the transom. Compared to conventional trim tab designs, the concave structure of the water channel enables the wake-modifying device to capture significantly more of the water flowing past the transom.

According to one embodiment, the water channel may include a convex upper portion, a concave trailing end portion, a planar lower portion and an inboard sidewall, all of which are coupled together or formed in an integral manner to produce the water channel. In such an embodiment, the inboard sidewall may be coupled to, or formed integral with, inboard edges of the convex upper portion, the concave trailing end portion and the planar lower portion to seal off the inboard side of the water channel. The outboard side of the water channel is left open. A majority of the center surface area of the planar lower portion and the concave trailing end portion is missing or removed to create openings in the planar lower portion and the concave trailing end portion. As the wake-modifying device is lowered into the water, the water flowing past the transom is pushed into the water channel through the opening in the planar lower portion, and flows out of the water channel primarily through the open outboard side to redirect water to the outboard side.

According to another embodiment, the water channel may include a downwardly inclined planar forward end portion, a planar upper portion, a downwardly inclined planar trailing end portion, and an inboard sidewall, all of which are coupled together or formed in an integral manner to produce the water channel. In some embodiments, the downwardly inclined planar trailing end portion comprises a substantially L-shaped bracket, which is coupled to a lower surface of the planar upper portion near a trailing end of the planar upper portion, and which extends down from the lower surface of the planar upper portion at an angle ranging between about 80° and about 160°. In other embodiments, the downwardly inclined planar trailing end portion may be formed at a trailing end of the planar upper portion by bending the trailing edge downward, so that at an angle ranging between about 80° and about 160° exists between a lower surface of the planar upper portion and the downwardly included planar trailing end portion. The inboard sidewall may be coupled to, or formed integral with, inboard edges of the downwardly inclined planar forward end portion and the planar upper portion to seal off the inboard side of the water channel. The outboard side of the water channel is left open. As the wake-modifying device is lowered into the water, the water flowing past the transom is captured and redirected by the water channel to the outboard side.

Various configurations of improved wake-modifying devices for a power boat are provided herein. All such configurations provide a water channel for capturing and redirecting significantly more of the water flowing past the transom of the boat than conventional trim tabs consisting primarily of a flat plate. This increases the upward force applied to the deployed wake-modifying device and raises the stern of the boat on the non-surf side to list the boat to the surf side, producing a larger wake on the surf side. Some configurations provide a convergent water channel, which accelerates the water diverted to the non-surf side and delays the convergence of constructively interfering wakes on the surf side (i.e., converges further away from the transom) to produce longer, smoother wakes on the surf side of the boat. In one example, a convergent water channel may be produced by configuring the water channel, such that the width of the water channel is larger on the inboard side and smaller on the outboard side. Other configurations provide a divergent water channel, which produces a comparatively shorter, taller wake by decreasing the velocity of the water diverted to the non-surf side, and enables constructively interfering wakes on the surf-side to converge sooner on the surf-side (i.e., converge nearer the transom). In one example, a divergent water channel may be produced by configuring the water channel, such that the width of the water channel is smaller on the inboard side and larger on the outboard side. Other configurations may provide a water channel of substantially consistent width.

In some embodiments, a wedge may be coupled within, and to an inboard side of, the water channel to redirect substantially more water out through the outboard side. The wedge may be implemented as an inclined plate or a solid wedge formed from a metal or plastic material, and may comprise a length ranging between about 4 inches and about 15 inches, and an angle of inclination ranging between about 3° and about 50°. In some embodiments, the wedge may be permanently attached to an inside surface of the water channel at the inboard side of the water channel. In other embodiments, the wedge may be attached to an inside surface of the water channel at the inboard side of the water channel by one or more mechanical fasteners, which enable the wedge to be removed. If attached by some non-permanent means, the wedge may be removed from the wake-modifying device and/or replaced with another wedge having a substantially different configuration.

In some embodiments, the hinge directly couples the water channel to the transom, so that water flowing past the transom is redirected to flow substantially parallel to the transom when the wake-modifying device is deployed. In other embodiments, the hinge couples the water channel to a trailing end of an angled plate, whose opposite end (i.e., forward end) is fixedly attached to the transom. If included, the angled plate may be dimensioned, so that the water channel is rotated away from the transom by about 1° to about 45°. By redirecting water to the outboard sides of the boat at an acute angle (β) to the transom, rather than the substantially more parallel redirection noted above, the angled plate functions to further delay convergence of the interfering waves on the surf side to produce even longer, smoother wakes.

BRIEF DESCRIPTION OF THE DRAWINGS

Other objects and advantages of the invention will become apparent upon reading the following detailed description and upon reference to the accompanying drawings in which.

Figure 1:
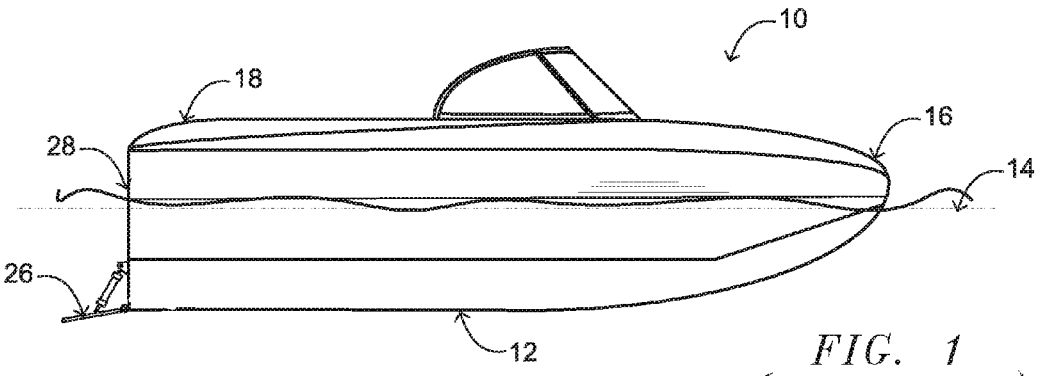
FIG. 1 (Prior Art)
FIG. 1 is a side view of a boat having a hull with a bow and a stern, and a center trim plate mounted to the transom of the stern.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

FIGS. 4-17 illustrate various embodiments of improved port and starboard trim tabs (i.e., "wake-modifying devices") for a power boat. As will be set forth in more detail below, the improved wake-modifying devices described herein are configured to manipulate the size and shape of the wake (or wave) produced by the power boat, particularly by channeling significantly more water to the non-surf side of the boat, so that constructive interference of waves converging behind the boat form a substantially larger, smoother wake on the surf-side of the boat. Variations of the wake-modifying devices are provided herein to further alter the shape of the wake. In many cases, the configuration of a wake-modifying device to accomplish the noted objectives may be specific for water sports performed behind a boat, such as but not limited to, water skiing, knee boarding, wake boarding, wake surfing, hydrofoiling and tubing.

Figure 2:
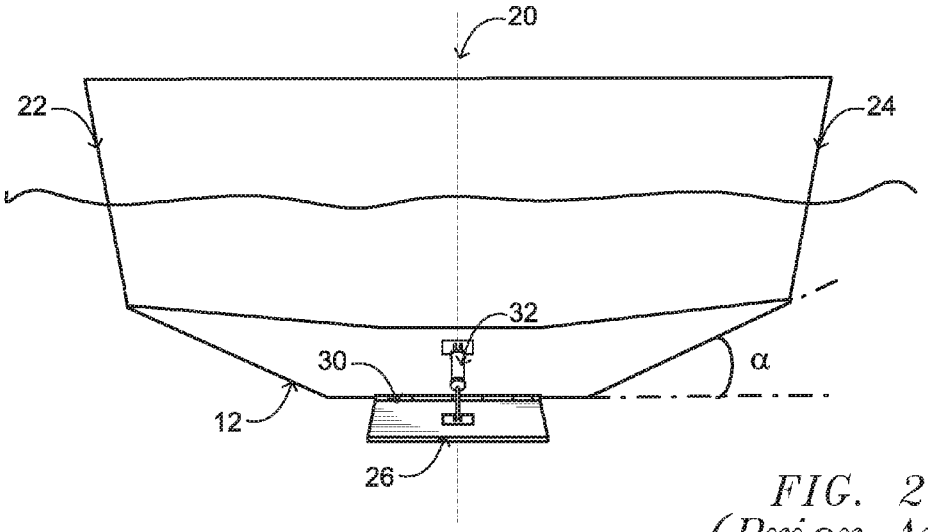
FIG. 2 (Prior Art)
FIG. 2 is a rear view of a boat having a deep V-shaped hull at the transom, and further illustrating a center trim plate mounted to the transom.
Figure 3:
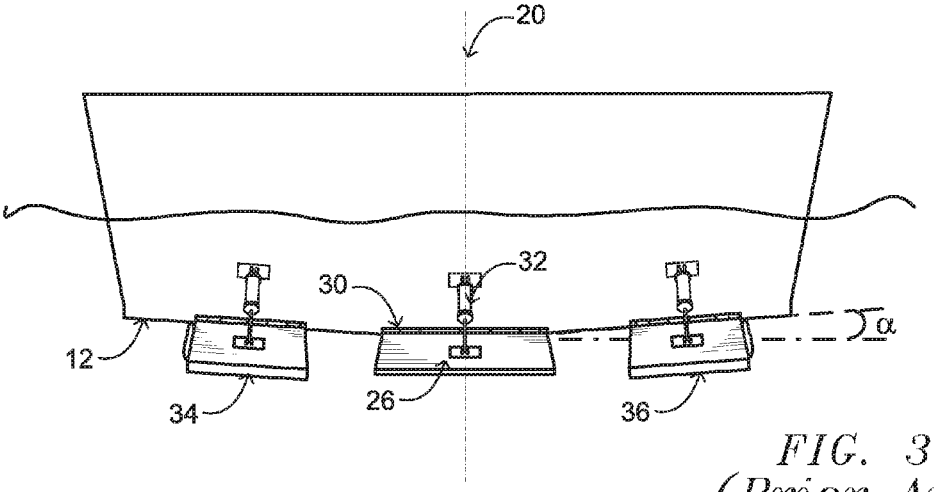
FIG. 3 (Prior Art)
FIG. 3 is a rear view of a boat having a flat or shallow V-shaped hull at the transom, and further illustrating a center trim plate and port and starboard trim tabs mounted to the transom.

Several example configurations of wake-modifying devices are shown and described in reference to FIGS. 4-17 that may be used for power boats including, but not limited to, the boats depicted in FIGS. 1-3 as having deep V-shaped hulls and shallower hulls. However, the wake-modifying devices described herein may be particularly useful for those boats having substantially shallower hulls, as these hull designs do not inherently produce the large wakes desired in some water sports without the use of such devices or significant ballasting in the stern of the boat. As will be set forth in more detail below, the boats and wake-modifying devices described herein are not limited to the example depictions shown in the drawings. Furthermore, it is noted that the drawings are not necessarily drawn to scale in that particular features may be drawn to a larger scale than other features to emphasize their characteristics.

Power boat 10 may, in general, be any type and size of motor boat. In some cases, power boat 10 is preferably an inboard boat, since wake surfing is preferably performed on inboard boats as a safety precaution. However, power boat 10 is not limited to wake surfing and may be used to perform a wide variety of water sports. As a consequence, the wake-modifying devices described herein may be equally useful for modifying the size and shape of the wake produced by outboard boats and inboard/outboard boats.

As used herein, the term "inboard boat" refers to a boat having an engine disposed within a hull of the boat and a drive propeller disposed beneath the hull. With respect to FIG. 1, in embodiments in which boat 10 is an inboard boat, the engine would be disposed within hull 12 with a drive propeller beneath the hull. The engine of an inboard boat may be referred to herein as an "inboard engine". Inboard boats considered herein may have a v-drive or a direct drive configuration. As used herein, a direct drive inboard configuration has the powerplant mounted near the middle of the boat with the propeller shaft straight out the back, where a v-drive configuration has the powerplant mounted in the back of the boat facing backwards having the shaft directed towards the front of the boat and then making a 'V' towards the rear. The v-drive configuration has become increasingly prevalent due to the relatively recent popularity of wake-boarding and wake surfing.

As noted above, boat 10 may be any size of motor boat. In some cases, the length of boat 10 between the bow 16 and the stern 18 may be less than 26 feet and, more specifically, between approximately 16 feet and approximately 26 feet. In particular, boats of such length ranges may be more apt to realize the manipulative features of the wake-modifying devices described herein as opposed to smaller or larger boats. More specifically, smaller boats (i.e., boats less than 16 feet in length) may not have sufficient weight or weight capacity to facilitate the manipulation of water needed to make a wake of particular size and/or shape using the wake-modifying devices described herein. Moreover, larger boats (i.e., boats of 26 feet length or greater) may be too heavy and/or bulky to realize the benefit of the wake-modifying devices described herein to make a wake of particular size and/or shape.

Figure 4:
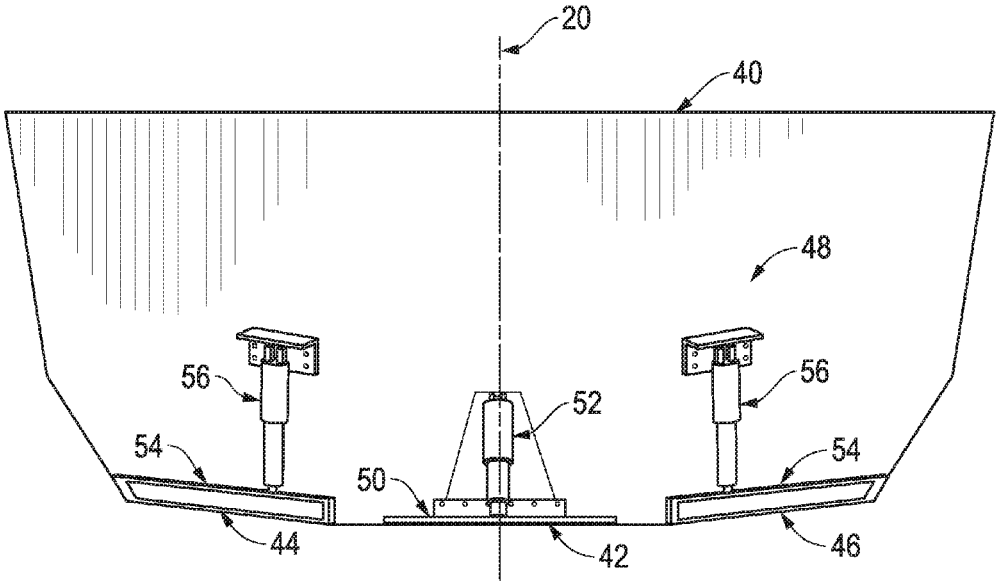
FIG. 4 is a rear view illustrating a center trim plate and a pair of improved wake-modifying devices attached to the transom of a boat, according to a first embodiment.

Turning to FIG. 4, a power boat 40 is depicted as including a center trim plate 42 pivotably mounted to the transom 48 at the center line 20, and a pair of wake-modifying devices 44 and 46 pivotably mounted to the transom 48 on the port and starboard sides of the center line 20. In some embodiments, the center trim plate 42 may be similar to the center trim plate 26 described above with reference to FIGS. 1-3. For example, the center trim plate 42 may consist of a flat, substantially rectangular plate, which is coupled to the transom 48 via a hinge 50 and linear actuator 52. In other embodiments, the center trim plate 26 may not be substantially flat, and may instead be angled. In some embodiments, hinge 50 may be coupled to transom 48 at the bottom of the hull, so that the bottom surface of the plate 42 is relatively flush with the bottom surface of the hull. As shown in FIG. 4, hinge 50 may be coupled to transom 48 along a line, which is substantially parallel to the horizontal, so that the center trim plate 42 may be raised and lowered along an arc that is substantially perpendicular to the horizontal plane.

The linear actuator 52 generally functions to move the center trim plate 26 from a non-deployed position (e.g., out of the water) to a deployed position (e.g., into the water). Example hydraulic actuator 52 is shown in FIG. 4, but other types and arrangements of actuators may be used. In some embodiments, the configuration of the center trim plate and method of operation may be similar to that disclosed for the plates described in U.S. Pat. No. 5,549,071 and U.S. Pat. No. 6,874,441, both of which are incorporated by reference as if set forth fully herein.

Like the center trim plate 42, the wake-modifying devices 44 and 46 are also coupled to the transom 48 via hinges 54 and linear actuators 56. Like linear actuator 52, linear actuators 56 generally function to move the wake-modifying devices 44 and 46 from a non-deployed position (e.g., out of the water) to a deployed position (e.g., into the water). Example hydraulic actuator 56 is shown in FIG. 4, but other types and arrangements of actuators may be used.

In some embodiments (see, e.g., FIGS. 5-6), the hinge 54 of each wake-modifying device 44, 46 may be directly attached to the transom 48 (via a mounting bracket 58), so that a pivot axis of the hinge 54 is substantially parallel to a vertical plane comprising the transom. In other embodiments (see, e.g., FIG. 7), the hinge 54 of each wake-modifying device 44, 46 may be attached to an angled plate 70 that is attached to the transom 48 (via a mounting bracket 72), so that the pivot axis of the hinge 54 lies at an acute angle (0) to the vertical plane comprising the transom. Each embodiment may produce a substantially different wake or wave, as discussed in more detail below.

In some embodiments, each wake-modifying device 44 and 46 may be coupled to the transom 48, so that the hinge 54 of the wake-modifying device 44 and 46 is relatively flush with the bottom surface of the hull. Depending on the deadrise angle of the hull, the wake-modifying devices 44 and 46 may be coupled to the transom 48, so that the hinge 54 of each wake-modifying device is inclined approximately 5° to approximately 12° from the horizontal plane. However, it is not necessary for the wake-modifying devices 44 and 46 to mimic the deadrise angle of the hull in all embodiments. In other embodiments, the wake-modifying devices 44 and 46 may alternatively be mounted at some angle of inclination, which is substantially less than or greater than the deadrise angle of the hull.

One important distinction between the wake-modifying devices 44 and 46 shown in FIG. 4 and the conventional port and starboard trim tabs 34 and 36 shown in FIG. 3 is the unique shape or contour of the wake-modifying devices 44 and 46. Instead of configuring the port and starboard trim tabs 34 and 36 as flat plates with one or more downturned or upturned edges, the wake-modifying devices 44 and 46 shown in FIG. 4 provide a hollow cavity or water channel, which is configured for redirecting water flowing behind the transom. Exemplary embodiments of wake-modifying devices 44 and 46 are shown more clearly in FIGS. 5-7. It is noted, however, that the wake-modifying devices 44 and 46 are not limited to the exemplary configurations shown in FIGS. 5-7, and may be alternatively configured in other embodiments.

Figure 5:
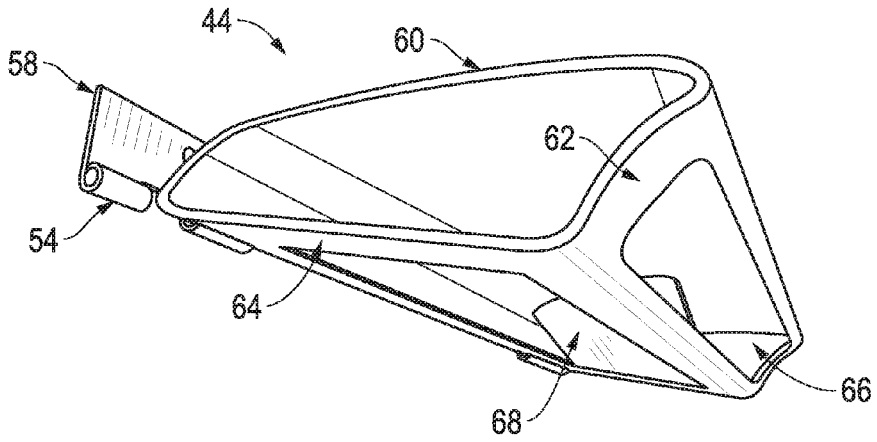
FIG. 5 is a side view of the port side wake-modifying device shown in FIG. 4.
Figure 6:
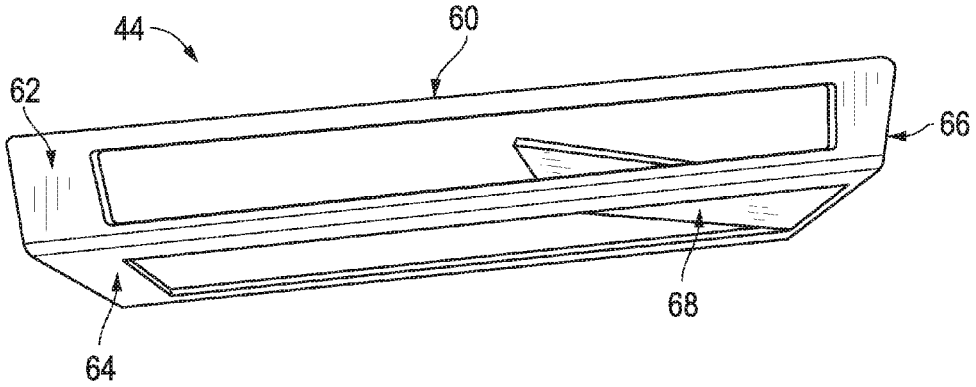
FIG. 6 is a rear view of the port side wake-modifying device shown in FIG. 4.
Figure 7:
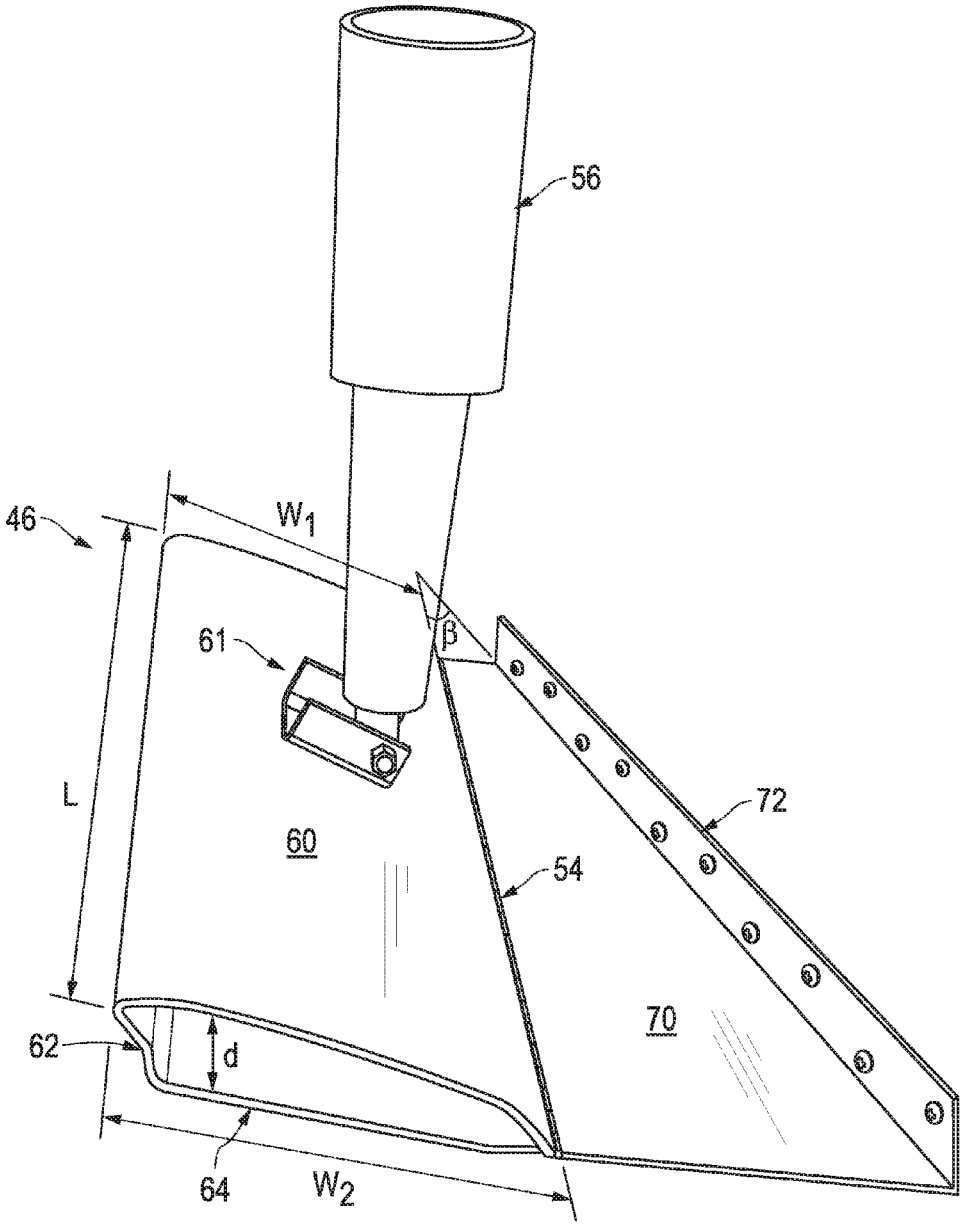
FIG. 7 is top perspective view of a starboard side wake-modifying device similar to the embodiment shown in FIG. 4, illustrating the wake-modifying device pivotably mounted to an angled plate which is attached to the transom of the boat.

In FIGS. 5-6, a port side wake-modifying device 44 is depicted as comprising an outwardly curved (i.e., convex) upper portion 60, an inwardly curved (i.e., concave) trailing end portion 62, and a substantially planar lower portion 64, all of which are coupled together or formed in an integral manner to produce a water channel configured for redirecting water flowing behind the transom. A starboard side wake-modifying device 46 is shown in FIG. 7. With the exception of angled plate 70 (which is discussed in more detail below), the starboard side wake-modifying device 46 may be a mirror image of the port side wake-modifying device 44. As such, the starboard side wake-modifying device 46 may also include a convex upper portion 60, a concave trailing end portion 62, and a substantially planar lower portion 64, which are coupled together or formed in an integral manner to produce a water channel for redirecting water on the starboard side. Similar features shown and described in FIGS. 5-6 for the port side wake-modifying device 44 may be equally applied to the starboard wake-modifying device 46 shown in FIG. 7 (and vice versa). Therefore, further reference to the "wake-modifying device" shown in FIGS. 5-7 may apply equally to the port and starboard side devices 44 and 46.

As shown in FIG. 7, an actuator mounting bracket 61 is coupled to the convex upper portion 60 of the wake-modifying device 46 for attaching the linear actuator 56 shown in FIG. 4 thereto. As noted above, linear actuators 56 generally function to move the wake-modifying devices 44 and 46 from a non-deployed position (e.g., out of the water) to a deployed position (e.g., into the water) by pivoting at least a portion of the devices 44 and 46 about a hinge 54. Although not explicitly shown in other figures described herein, one skilled in the art would understand how other embodiments of the disclosed wake-modifying device may also include an actuator mounting bracket (similar to bracket 61) for attaching the wake-modifying device to a linear actuator.

The "water channel" described herein and shown in the drawings is a concave structure, which is configured for channeling water to the outboard side of the water channel. Unlike conventional port and starboard trim tabs, the concave structure is specifically designed to include downwardly curved or inclined forward end and trailing end portions. As used herein, the "forward end portion" refers to the longitudinal portion of the water channel closest to the transom, while the "trailing end portion" refers to the longitudinal portion of the water channel furthest from the transom. As noted above, the "water channel" shown in FIGS. 5-7 comprises convex upper portion 60, concave trailing end portion 62, and planar lower portion 64. Thus, in the embodiment shown in FIGS. 5-7, the "forward end portion" of the water channel includes the downwardly curved longitudinal portion of the convex upper portion 60 located at the forward end of the water channel. Likewise, the "trailing end portion" of the water channel includes the downwardly curved longitudinal portion of the convex upper portion 60 located at the trailing end of the water channel, along with concave trailing end portion 62.

As shown most clearly in FIGS. 5-6, a majority of the center surface area may be removed from both the planar lower portion 64 and the concave trailing end portion 62 of the wake-modifying device. As the wake-modifying device is lowered into the water, the water flowing past the transom 48 is pushed into the water channel of the device through the opening in the planar lower portion 64, and flows out of the water channel primarily through the open outboard side, and to some extent through the opening in the trailing end portion 62.

In some embodiments, an inboard sidewall 66 may be coupled or formed integral with inboard edges of portions 60, 62 and 64 to seal off the inboard side of the water channel, while the outboard side of the water channel is left open. If included, the inboard sidewall 66 may improve rigidity of the wake-modifying device and/or assist in deflecting or redirecting water flowing behind the transom to the outboard side of the boat. As described in more detail below, the inboard sidewall 66 may not be needed in all embodiments, and thus, may be considered to be an optional component of the wake-modifying device.

In some embodiments, an inclined plate or wedge-like structure 68 may be coupled to at least one inside surface of the wake-modifying device to redirect substantially more water out through the open outboard side. In some embodiments, wedge 68 may be an inclined plate formed from a metal or plastic material, as shown in FIGS. 5-6. In other embodiments, wedge 68 may be a solid wedge formed from a metal or plastic material. As used herein, the term "wedge" encompasses both an inclined plate and a solid wedge.

If an inclined plate is used to implement wedge 68, the inclined plate may be formed as an integral part of the inboard sidewall 66, an integral part of the planar lower portion 64, or as a separate piece. In one example, an inclined plate may be formed when the center surface area of the planar lower portion 64 is removed to create the opening in the planar lower portion. However, instead of removing the entire center surface area as described above, a rectangular shaped portion of the center surface area may be cut on three sides, but left intact on the fourth side, so that the rectangular shaped portion may be bent upwards into the water channel to form the wedge 68. Alternatively, the inclined plate could be fabricated as a separate piece, which is subsequently attached to one or more inside surfaces of the convex upper portion 60, planar lower portion 64 and inboard sidewall 66 using some permanent or non-permanent means.

According to another embodiment, wedge 68 may be a solid wedge, which is formed from a metal or plastic material using any appropriate process (e.g., molding, machining, extrusion, etc.). Examples of suitable materials that may be used to form a solid wedge include, but are not limited to, a molded plastic, machined aluminum, machined plastic, bent stainless steel, extruded metal. If a solid wedge is used to implement the wedge 68, the solid wedge may be fabricated as a separate piece, which is subsequently attached to one or more inside surfaces of the convex upper portion 60, planar lower portion 64 and inboard sidewall 66 using some permanent or non-permanent means.

In some embodiments, inboard sidewall 66 may not be necessary when wedge 68 is a solid wedge. For example, a solid wedge may be formed, so that the width of an inboard side of the wedge is substantially equal to the width of the water channel on the inboard side. When the solid wedge is subsequently attached to one or more inside surfaces of the convex upper portion 60 and planar lower portion 64, the inboard side of the solid wedge may be used in place of inboard sidewall 66 to seal off the inboard side of the water channel. If an inboard sidewall 66 is included within the wake-modifying device, however, the inboard side of the solid wedge may be additionally or alternatively attached to the inboard sidewall.

In some embodiments, the wedge 68 may be permanently attached to one or more inside surfaces of the convex upper portion 60, planar lower portion 64 and inboard sidewall 66, such that the wedge 68 cannot be removed. For example, if the wedge 68 is formed from a metal material, the wedge may be welded to one or more inside surfaces of the convex upper portion 60, planar lower portion 64 and inboard sidewall 66, one example of which is shown in FIGS. 5-6. Alternatively, the wedge 68 may be attached by some non-permanent means (e.g., screws or other mechanical fasteners), so that the wedge 68 may be removed and/or swapped for a wedge with a substantially different configuration.

In some embodiments, the wedge 68 may comprise a length ranging between about 4 inches and about 15 inches, and an angle of inclination ranging between about 3° and about 50°. In some embodiments, a plurality of wedges 68 may be provided with a variety of different lengths and angles of inclination, and a particular wedge may be selected for use within the wake-modifying device depending on a configuration of the hull at the transom of the boat. In one example, a wedge 68 having a relatively shorter length (e.g., about 3 to 10 inches) and greater angle of inclination (e.g., about 25° to 50°) may be selected for use with shallower boat hulls, whereas boats with deeper V-shaped hulls may utilize a wedge 68 having a relatively longer length (e.g., about 5 to 15 inches) and smaller angle of inclination (e.g., about 3° to 10°). The configuration of the wedge 68 may additionally or alternatively depend on one or more additional features of the hull, such as the presence (or absence) and configuration of the strakes, chines, trailing lip, ballast and other hull angles.

Although proven to be beneficial for some boats, wedge 68 may not necessarily be needed for all boats, and thus, may be considered to be an optional feature of the wake-modifying devices described herein. For example, wedge 68 may not be needed when the wake-modifying device is attached to a boat having a relatively deep-V shaped hull (e.g., a boat having a deadrise angle between about 15° and 45° at the stern). As noted above, boats with deep-V shaped hulls are designed for producing relatively large wakes, and thus, may not benefit from or require the use of a wedge. On the other hand, wedge 68 may be useful when the wake-modifying device is attached to a boat having a substantially flatter hull (e.g., a boat having a deadrise angle between about 0° and 15° at the stern). These boats are not designed for producing relatively large wakes, and thus, may benefit from the use of a wedge 68 within the wake-modifying device.

Compared to conventional trim tab designs, the port side wake-modifying devices shown in FIGS. 4-7 are designed to redirect significantly more of the water flowing past the transom to the outboard side (in this case, the port side) of the boat. More water is diverted, due to the unique contour of the wake-modifying device and the water channel formed thereby. It is believed that, when the port side wake-modifying device 44 shown in FIGS. 4-6 is lowered into the water, the water channel of the wake-modifying device captures significantly more of the water flowing past the transom 48 than conventional trim tabs consisting primarily of a flat plate. This increases the upward force applied to the inside surface of the convex upper portion 60 and raises the stern of the boat on the port side to list the boat to the starboard side, producing a larger wake on the starboard side. In addition, more water is redirected by the water channel and the (optional) wedge 68 through the open outboard side of the port side wake-modifying device 44. This delays the convergence of constructively interfering waves on the starboard side, thus producing longer, smoother waves on the starboard side of the boat. The opening formed in the trailing end portion 62 is provided, in some embodiments, to reduce drag and save on fuel economy. The starboard side wake-modifying device 46 shown in FIGS. 4 and 7 is generally configured as a mirror image to the port side wake-modifying device 44, and thus, functions similarly to produce larger, smoother waves on the port side of the boat.

According to one embodiment, the port and starboard side wake-modifying devices shown in FIGS. 4-7 may be formed from a metal, plastic or fiberglass plate using any appropriate process or processes (e.g., cutting, stamping, bending, welding, etc.). In general, the plate may comprise a material having a strength and/or thickness sufficient to resist substantial deformation when in contact with the forces applied to the wake-modifying device by the water flowing past the transom when the device is deployed. Materials appropriate for use may include, but are not limited to, plastics, plastic composites, aluminum, stainless steel, and fiberglass. Although not limited to such, a thickness of the plate may range between about 1/16" and about 1/4", in some embodiments.

The port and starboard side wake-modifying devices 44 and 46, and more specifically, the water channel of those devices, may have substantially any dimensions deemed necessary to produce a desirable wake. According to one exemplary embodiment (see, FIG. 7), the water channel of the each wake-modifying device may have a length (L) ranging between about 6 inches and about 36 inches, a width ($W_1$, $W_2$) ranging between about 4 inches and about 18 inches, and a maximum depth (d) ranging about 2 inches and about 6 inches.

In one embodiment, a width ($W_1$) of the water channel on the inboard side may be substantially smaller than a width ($W_2$) of the water channel on the outboard side, such that the trailing edge portion 62 and the pivot axis provided by the hinge 54 lie along divergent, non-parallel lines, as shown in FIG. 7. According to one example, the width ($W_1$) of wake-modifying device on the inboard side may be about 4 inches to about 6 inches, and the width ($W_2$) of the wake-modifying device on the outboard side may be about 6 inches to about 18 inches. This configuration produces a divergent water channel (divergent to the outboard side), which decreases the velocity of the water diverted to the non-surf side, and enables interfering wakes on the surf-side to converge sooner (i.e., converge nearer the transom) to produce a comparatively shorter (in distance) and taller (in height) wake on the surf-side.

In another embodiment (not shown in FIGS. 4-7), the width ($W_1$) on the inboard side may be substantially larger than the width ($W_2$) on the outboard side of the wake-modifying device, so that trailing edge portion 62 and hinge 54 lie along convergent, non-parallel lines. In one example, the width ($W_1$) on the inboard side may be about 6 inches to about 18 inches, and the width ($W_2$) on the outboard side may be about 4 inches to about 6 inches. This configuration produces a convergent water channel (convergent to the outboard side), which increases the velocity of the water diverted to the non-surf side, and enables interfering wakes on the surf-side to converge later (i.e., converge farther from the transom) to produce a comparatively longer (in distance) and shorter (in height) wake on the surf-side.

In the exemplary embodiment shown in FIGS. 4-6, the hinges 54 of the wake-modifying devices 44 and 46 are attached directly to the transom 48 via mounting bracket 58. The embodiment shown in FIG. 7 differs from the one shown in FIGS. 4-6 by attaching the hinges 54 of the wake-modifying devices 44 and 46 to a trailing end of an angled plate 70, whose opposite end (i.e., forward end) is fixedly attached to the transom 48 by mounting bracket 72. As used herein, the "trailing end" of a component refers to the longitudinal edge of the component furthest from the transom, while the "forward end" of the component refers to the longitudinal edge of the component closest to the transom.

Mounting bracket 72 may be coupled to, or formed integral with, angled plate 70. In one embodiment, mounting bracket 72 may be formed integral with angled plate 70 by bending the forward end of the angled plate 70 upwards, so that a substantially right angle (i.e., an angle between about 80° and about 100°) is formed between angled plate 70 and mounting bracket 72. In another embodiment, mounting bracket 72 may be welded onto the forward end of angled plate 70 at the desired angle. In either embodiment, mounting bracket 72 is fixedly or permanently attached to the angled plate 70. In an alternative embodiment, mounting bracket 72 may be pivotably attached to the angled plate 70 by an additional hinge (not shown) coupled to the forward end of angled plate 70. If included, the additional hinge may allow the angled plate 70 to pivot away from/towards the transom.

In the embodiment of FIG. 7, the angled plate 70 is dimensioned, so that the wake-modifying device is rotated away from the transom at an acute angle (β) to the transom 48. In one example, the angled plate 70 may be dimensioned, so that the wake-modifying device is rotated approximately 1° to approximately 45° away from the transom. In some embodiments, the angled plate 70 may be dimensioned, so that the wake-modifying device is rotated approximately 10° to approximately 45° away from the transom. By redirecting water to the outboard sides of the boat at an acute angle (β) to the transom, rather than the substantially more parallel redirection shown in FIGS. 5-6, the embodiment shown in FIG. 7 further delays convergence of the interfering waves on the opposite side of the boat (i.e., the "surf side") to produce longer, smoother wakes.

Figure 8:
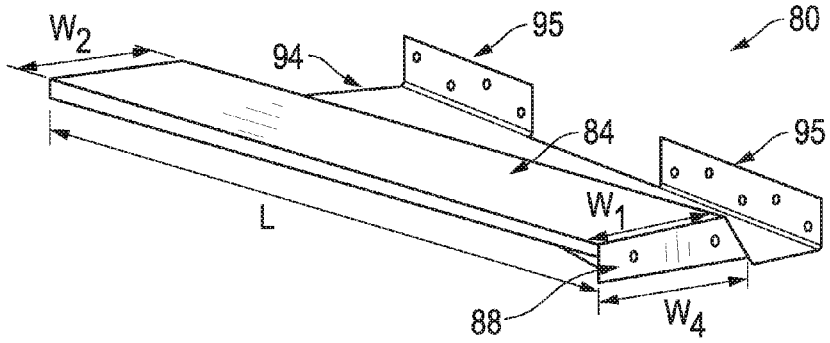
FIG. 8 is a perspective top view of an improved port side wake-modifying device, according to a second embodiment.
Figure 9:
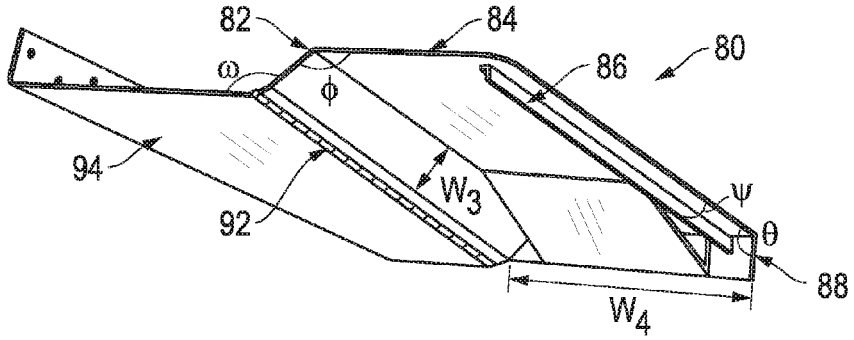
FIG. 9 is a perspective bottom view of the improved port side wake-modifying device shown in FIG. 8.
Figure 10:
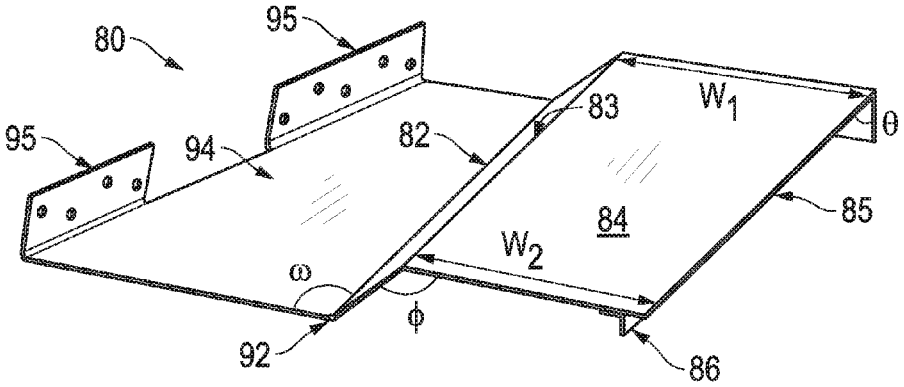
FIG. 10 is a perspective top view of an improved port side wake-modifying device, according to a third embodiment.

FIGS. 8-10 illustrate various alternative embodiments of a port side wake-modifying device 80. Although not shown in FIGS. 8-10, a starboard side wake-modifying device may be configured as a mirror image to the port side wake-modifying device 80. Therefore, further reference to the "wake-modifying device" in FIGS. 8-10 may apply equally to the port and starboard side wake-modifying devices.

The exemplary embodiments shown in FIGS. 8-10 include many of the desirable features shown in FIGS. 4-7 with some key modifications. Like the previous embodiments, the wake-modifying device 80 shown in FIGS. 8-10 is designed to provide a water channel for capturing water flowing past the transom, and redirecting the water flow to the outboard side of the boat. Instead of the curved contours shown in FIGS. 4-7, however, the water channel depicted in FIGS. 8-10 is depicted as a concave structure having downwardly inclined planar forward end and trailing end portions. More specifically, the water channel shown in FIGS. 8-10 is formed so as to include a downwardly inclined planar forward end portion 82, a planar upper portion 84, and a downwardly inclined planar trailing end portion 86. In some embodiments, the wake-modifying device 80 may optionally include an inboard sidewall 88 and/or an inclined plate or wedge-like structure ("wedge") 90, as described in more detail below. The outboard side of the wake-modifying device 80 is left open. Although not shown in FIGS. 8-10, a linear actuator may be coupled between the transom and the planar upper portion 84 to move the wake-modifying device 80 from a non-deployed position (e.g., out of the water) to a deployed position (e.g., into the water), similar to the linear actuator 56 shown in FIGS. 4-7.

In the embodiment of FIGS. 8-10, the forward end portion 82 is coupled via a hinge 92 to a trailing end of an angled plate 94, whose opposite end (i.e., forward end) is fixedly attached to the transom via a mounting bracket 95. As in the previous embodiment shown in FIG. 7, the mounting bracket 95 may be coupled to, or formed integral with, the angled plate 94 so that a substantially right angle (i.e., an angle between about 80° and about 100°) is formed between the angled plate 94 and the mounting bracket 95. In addition, the angled plate 94 may be dimensioned, so that the water channel of the wake-modifying device 80 is rotated away from the vertical plane of the transom at an acute angle ($\beta$) (e.g., ranging between about 1° to about) 45° to delay convergence of the interfering waves on the opposite side of the boat (in this case, the starboard side) and produce longer, smoother wakes. According to one example, the angled plate 94 may be dimensioned, such that the water channel of the wake-modifying device is rotated approximately 15° away from the transom.

In the embodiment shown in FIGS. 8-10, forward end portion 82 is coupled to angled plate 94 via hinge 92, so that the water channel formed by components 82, 84, 86, 88 and/or 90 rotates about the pivot axis provided by hinge 92 when moved into and out of the water. According to one example, hinge 92 allows the water channel to rotate, such that an angle ($\omega$) between angled plate 94 and forward end portion 82 is adjustable from about 90° to about 150°. In another embodiment, hinge 92 may be alternatively arranged between angled plate 94 and the mounting bracket 95 attached to the transom, such that the angled plate 94 pivots along with the water channel when moved into and out of the water. In such an embodiment, the front end portion 82 may be formed integral with or joined to the angled plate 94 at a fixed angle (ranging, e.g., between about 90° to about 150°). In yet another embodiment, angled plate 94 may be omitted and the forward end portion 82 may be directly coupled to the transom by a hinge and mounting plate as shown, for example, in the embodiment of FIGS. 5-6.

As shown most clearly in FIGS. 9-10, the planar forward end portion 82 extends substantially along the length of the hinge 92 and abuts a first longitudinal edge (i.e., a forward edge) 83 of the planar upper portion 84. In some embodiments, a width ($W_3$) of the forward end portion 82 may range between about 1 inch and about 4 inches, and more preferably between about 2 inches and about 3 inches. In some embodiments, the forward end portion 82 and the planar upper portion 84 may be formed by bending an appropriately sized metal plate, such that an obtuse angle ($\phi$) is formed between the lower surface of the forward end portion 82 and the lower surface of the planar upper portion 84. The obtuse angle ($\phi$) may range between about 90° and about 160°, and in one embodiment, may be approximately 145°. Alternatively, the forward end portion 82 may be attached to the planar upper portion 84, e.g., by welding the two pieces together at any desirable angle.

In general, planar upper portion 84 may comprise a flat plate having a substantially quadrilateral shape of any dimensions needed for the wake-modifying device to produce a desirable wake. In the embodiment shown in FIGS. 8-9, planar upper portion 84 is a substantially rectangular plate having a length (L) ranging between about 6 inches and about 36 inches, and a width ($W_1$, $W_2$) ranging between about 4 inches and about 18 inches. In the embodiment shown in FIGS. 8-9, the width of the planar upper portion 84 is substantially consistent along the length of the planar upper portion 84 (i.e., $W_1$ is approximately equal to $W_2$). This configuration produces a wake-modifying device 80 with a water channel of substantially consistent width that neither converges nor diverges.

In the embodiment shown in FIG. 10, the length (L) of the planar upper portion 84 may also range between about 6 inches and about 36 inches. However, the width ($W_1$) of the planar upper portion 84 on the inboard side is substantially larger than the width ($W_2$) of the planar upper portion 84 on the outboard side. According to one example, the width ($W_1$) of the upper surface 84 on the inboard side may be about 6 inches, and the width ($W_2$) of the upper surface 84 on the outboard side may be about 4 inches. This configuration produces a wake-modifying device 80 with a convergent water channel. In alternative embodiments, a wake-modifying device 80 with a divergent water channel may be produced by making the width ($W_1$) of the planar upper portion 84 on the inboard side substantially smaller than the width ($W_2$) of the planar upper portion 84 on the outboard side. An example of a divergent water channel is shown in FIGS. 11-17 and discussed in more detail below.

In general, the downwardly inclined trailing end portion 86 may have a length substantially equal to the length (L) of the planar upper portion 84, and may extend down from a lower surface of the planar upper portion. Although the downwardly inclined trailing end portion 86 is illustrated in FIGS. 8-10 as extending down from the lower surface of the planar upper portion 84 at an angle ($\psi$) of about 90°, the angle may alternatively range between about 80° and about 160°. In FIGS. 8-10, the downwardly inclined trailing end portion 86 is also illustrated as extending down approximately 1-2 inches from the lower surface of the planar upper portion 84. In some embodiments, the downwardly inclined trailing end portion 86 may extend further down from the lower surface of the planar upper portion 84 (e.g., about 2-6 inches) to increase the depth of the water channel.

In the particular embodiment shown in FIGS. 8-10, the downwardly inclined trailing end portion 86 is a substantially L-shaped bracket, which is coupled to a lower surface of the planar upper portion 84 near a second longitudinal edge (i.e., near the trailing end) 85 of the planar upper portion 84. In another embodiment (not shown), the downwardly inclined trailing end portion 86 may be a substantially L-shaped bracket, which is coupled to the lower surface of the planar upper portion 84 at the second longitudinal edge (i.e., at the trailing end) 85 of the planar upper portion 84. In such embodiments, the downwardly inclined the trailing end portion 86 may be coupled to the lower surface of the planar upper portion 84 by substantially any means including, but not limited to, welded joints, screws or other mechanical fasteners. In yet another embodiment (shown, e.g., in FIGS. 11-17), the downwardly inclined trailing end portion 86 may be formed integral with the second longitudinal edge 85 by bending the second longitudinal edge downward to form the downwardly inclined trailing end portion 86.

In some embodiments, an inboard sidewall may be included to improve the rigidity of the wake-modifying device and/or assist in deflecting or redirecting water flowing behind the transom to the outboard side of the boat. In the embodiments shown in FIGS. 8-10, inboard sidewall 88 extends substantially along the width ($W_1$) of the planar upper portion 84 at the inboard side of the wake-modifying device 80, and is coupled to inboard side edges of both the forward end portion 82 and the planar upper portion 84, so as to seal off the inboard side of the wake-modifying device. In general, the inboard sidewall 88 may extend downward from the inboard edge of the planar upper portion 84 about 1-3 inches at an angle (θ) between about 90° to about 100°. In one example, the inboard sidewall 88 may extend down about 1 inch and at an angle (θ) of about 95° from the inboard edge of the planar upper portion 84.

In some embodiments, an (optional) wedge 90 may be coupled between the inboard sidewall 88 and a lower surface of the planar upper portion 84 to redirect substantially more water out through the open outboard side. The wedge 90 may be an inclined plate (as shown in FIG. 9) or a solid wedge (not shown), and may be formed from a metal, plastic or fiberglass material using an appropriate process.

If an inclined plate is used to implement wedge 90, the inclined plate may be formed as an integral part of the inboard sidewall 88 or as a separate piece, which is subsequently attached to one or more lower surfaces of the inboard sidewall 88 and the planar upper portion 84 using some permanent or non-permanent means. If a solid wedge is used to implement the wedge 90, the solid wedge may be fabricated as a separate piece, which is subsequently attached to one or more inside surfaces of the inboard sidewall 88 and the planar upper portion 84 using some permanent or non-permanent means. Examples of suitable materials that may be used to form the inclined plate and the solid wedge are discussed above.

In some embodiments, wedge 90 may be permanently attached to one or more inside surfaces of the inboard sidewall 88 and/or the planar upper portion 84, so that wedge 90 cannot be removed. For example, if the wedge 90 is formed from a metal material, the wedge may be welded onto one or more inside surfaces of the inboard sidewall 88 and/or the planar upper portion 84. Alternatively, the wedge 90 may be attached by some non-permanent means (e.g., screws or other mechanical fasteners), so that the wedge 90 may be removed and/or swapped for a wedge with a different configuration. In the embodiments of FIGS. 8-9, wedge 90 is attached to the inboard sidewall 88 with screws.

In some embodiments, the wedge 90 may be formed so as to comprise a length between about 4 inches and about 15 inches, and an angle of inclination between about 3° and about 50°. According to one example, the wedge 90 may comprise a length of about 6 inches and an angle of inclination (ψ) of about 10°. In some embodiments, wedge 90 may be provided with a variety of different lengths and angles of inclination, and a particular wedge may be selected for use within the wake-modifying device depending on the configuration of the hull. In one example, a wedge 90 having a relatively shorter length (e.g., about 3 to 10 inches) and greater angle of inclination (e.g., about 25° to 50°) may be selected for use with shallower boat hulls, whereas boats with deeper V-shaped hulls may benefit from a wedge 90 having a relatively longer length (e.g., about 5 to 15 inches) and smaller angle of inclination (e.g., about 3° to 10°). The configuration of the wedge 90 may additionally or alternatively depend on one or more additional features of the hull, such as the presence (or absence) and configuration of the strakes, chines, trailing lip, ballast and other hull angles.

Although proven to be beneficial for some boats, wedge 90 may not necessarily be needed for all boats, and thus, may be considered to be an optional feature of the wake-modifying device described herein. For example, wedge 90 may not be needed when the wake-modifying device is attached to a boat having a relatively deep-V shaped hull (e.g., a boat having a deadrise angle between about 15° and 45° at the stern). As noted above, boats with deep-V shaped hulls are designed for producing relatively large wakes, and thus, may not benefit from or require the use of a wedge. On the other hand, wedge 90 may be useful when the wake-modifying device is attached to a boat having a substantially flatter hull (e.g., a boat having a deadrise angle between about 0° and 15° at the stern). These boats are not designed for producing relatively large wakes, and thus, may benefit from the use of a wedge 90 within the wake-modifying device.

Compared to conventional trim tab designs, the port side wake-modifying device 80 shown in FIGS. 8-10 is designed to redirect significantly more of the water flowing past the transom to the outboard side (in this case, the port side) of the boat. More water is diverted, due to the unique contour of the wake-modifying device 80 and the water channel formed thereby. It is believe that, when the port side wake-modifying device 80 is lowered into the water, the water channel of the wake-modifying device 80 captures significantly more of the water flowing past the transom than conventional trim tabs consisting primarily of a flat plate. This increases the upward force applied to the lower surface of the planar upper portion 84 and raises the stern of the boat on the port side to list the boat to the starboard side, producing a larger wake on the starboard side. In addition, more water is redirected by the water channel and the (optional) wedge-90 through the open outboard side of the port side wake-modifying device 80. This delays the convergence of constructively interfering waves on the starboard side, thus producing longer, smoother waves on the starboard side of the boat. The starboard side wake-modifying device (shown, e.g., in FIG. 12) is generally configured as a mirror image to the port side wake-modifying device 80, and thus, functions similarly to produce larger, smoother waves on the port side of the boat.

According to one embodiment, the wake-modifying device 80 shown in FIGS. 8-10 may be formed from a metal, plastic or fiberglass plate using any appropriate process or processes (e.g., cutting, stamping, bending, welding, etc.). In general, the plate may comprise any material having a strength and/or thickness sufficient to resist substantial deformation when in contact with the forces applied to the wake-modifying device by the water flowing past the transom when the device is deployed. Materials appropriate for use may include, but are not limited to, plastics, plastic composites, aluminum, stainless steel, and fiberglass. Although not limited to such, a thickness of the metal plate may range between about 1/16" and about 1/4", in some embodiments.

The water channel of the wake-modifying device 80 may have substantially any dimensions deemed necessary to produce a desirable wake. In one example, the water channel may have a length (L) ranging between about 6 inches and about 36 inches, a width ($W_4$) ranging between about 4 inches and about 18 inches, and a maximum depth (d) ranging about 1 inch and about 5 inches. In the embodiment shown in FIGS. 8-9, the width ($W_4$) of the water channel is substantially consistent along the length (L) of the wake-modifying device to produce a water channel of substantially constant width.

However, it is generally preferred to vary the width ($W_4$) of the water channel along the length of the wake-modifying device to manipulate the hydrodynamic effect provided by the water channel, and thus, change the shape and size of the wake. In the embodiment shown in FIG. 10, the width ($W_1$) of the planar upper portion 84 on the inboard side is larger than the width ($W_2$) of the planar upper portion 84 on the outboard side, such that the trailing edge 85 of the wake-modifying device (or the downwardly inclined trailing end portion 86) and the pivot axis provided by the hinge 92 lie along convergent, non-parallel lines. According to one example, the width ($W_1$) of the upper surface 84 on the inboard side may be about 6 inches, and the width ($W_2$) of the upper surface 84 on the outboard side may be about 4 inches. This configuration produces a convergent water channel that accelerates the water through the channel to the non-surf side, and delays the convergence of constructively interfering waves on the surf side to produce longer, smoother waves on the surf side of the boat.

Figure 11:
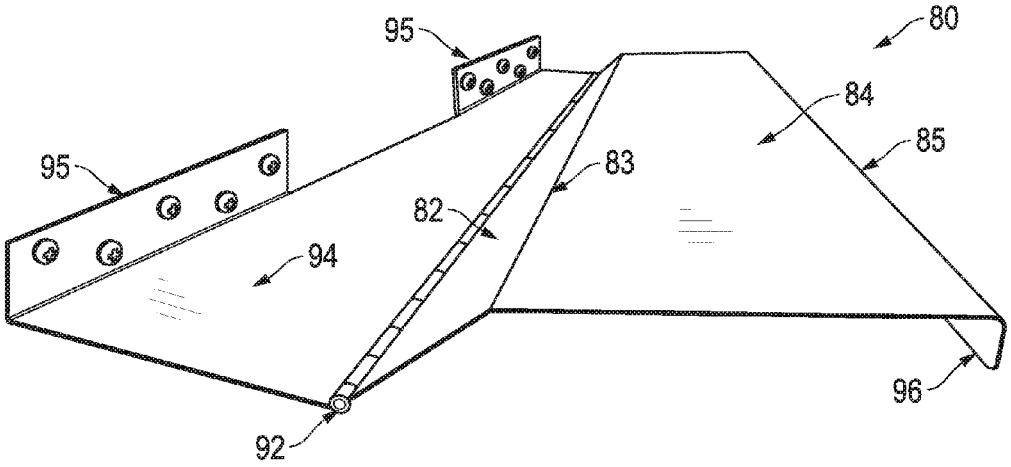
FIG. 11 is a side view of an improved port side wake-modifying device, according to a fourth embodiment.
Figure 12:
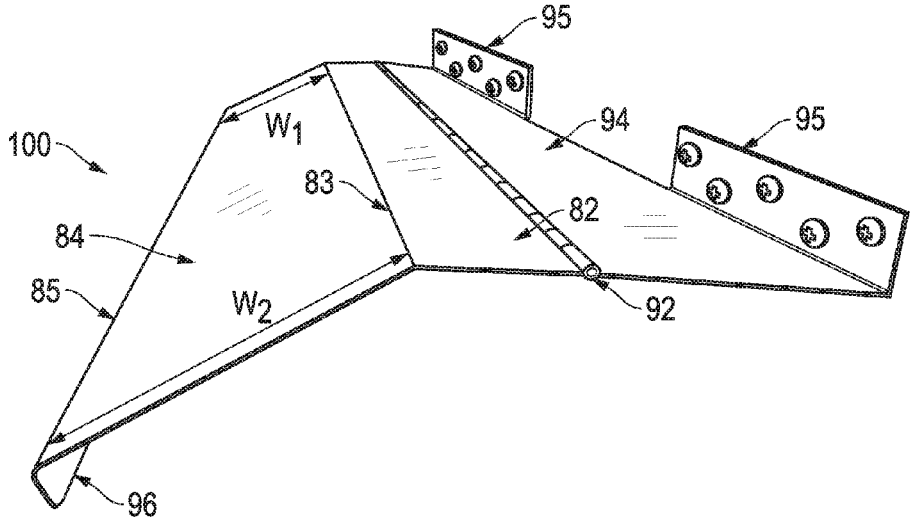
FIG. 12 is a side view of an improved starboard side wake-modifying device, according to the fourth embodiment.
Figure 13:
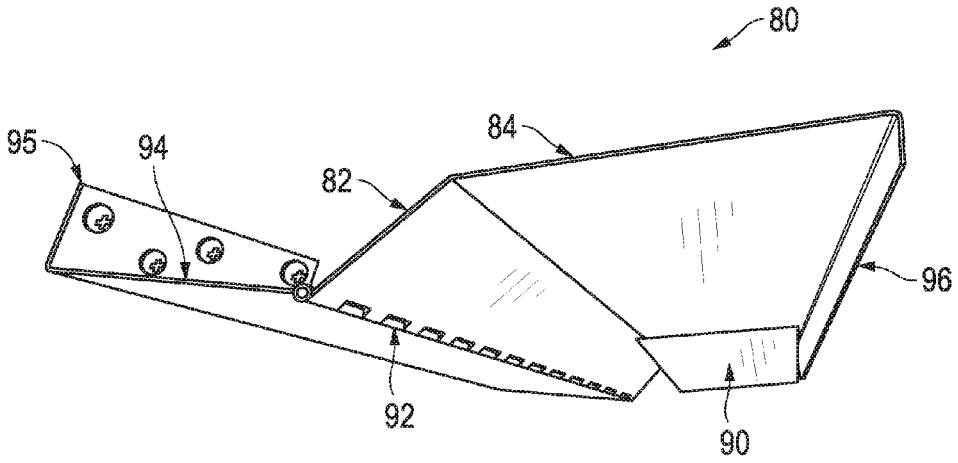
FIG. 13 is a bottom view of the improved port side wake-modifying device, according to the fourth embodiment.
Figure 14:
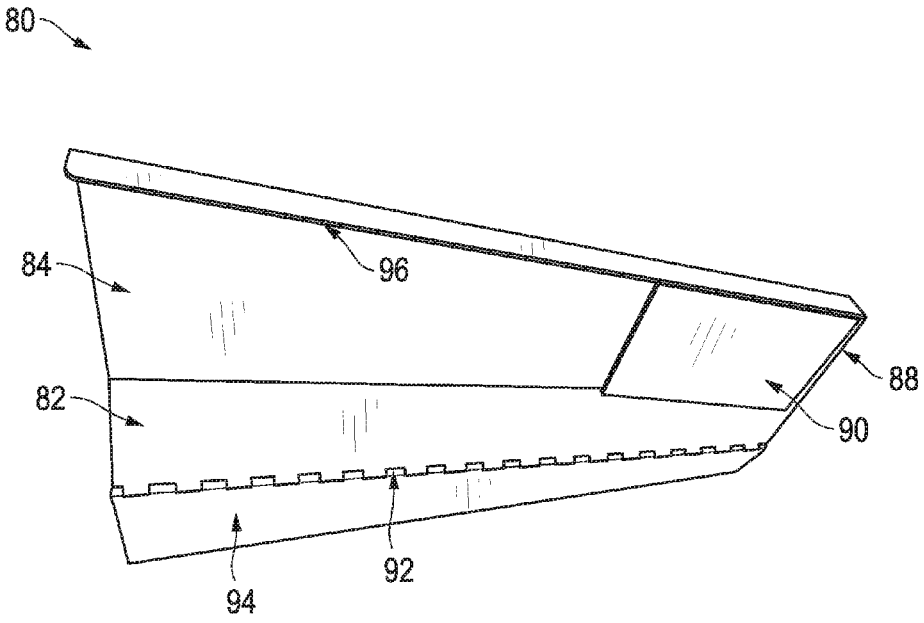
FIG. 14 is another bottom view of the improved port side wake-modifying device, according to the fourth embodiment.

An alternative configuration of the port side wake-modifying device 80 is shown in FIGS. 11, 13 and 14 with a corresponding starboard side wake-modifying device 100 shown in FIG. 12. The embodiment shown in FIGS. 11-14 is very similar to the embodiments shown in FIGS. 8-10. Like components are depicted with like numerals in FIGS. 8-10 and FIGS. 11-14 and will not be discussed further herein. There are two main differences between the embodiments shown in FIGS. 8-10 and the embodiment shown in FIGS. 11-14. First, instead of the L-shaped bracket 86 shown in FIGS. 8-10, the downwardly inclined trailing end portion 96 shown in FIGS. 11-14 is formed at the second longitudinal edge (i.e., at the trailing end) 85 of the planar upper portion 84 by bending the second longitudinal edge 85 downward to form the downwardly inclined trailing end portion 96. Second, the planar upper portion 84 is dimensioned in FIGS. 11-14, such that the width ($W_1$) of the planar upper portion 84 on the inboard side is substantially smaller than the width ($W_2$) of the planar upper portion 84 on the outboard side to produce a wake-modifying device 80, 100 with a divergent water channel.

According to one example, the width ($W_1$) of the upper surface 84 on the inboard side may be about 4 inches, and the width ($W_2$) of the upper surface 84 on the outboard side may be about 6 inches. These exemplary dimensions ensure that the trailing end 85 of the planar upper portion 84 and the pivot axis provided by the hinge 92 lie along divergent, non-parallel lines, similar to that shown in FIGS. 5-6 and described above, to produce a wake-modifying device 80, 100 with a divergent water channel. Compared to the convergent water channel shown in FIG. 10, the divergent water channel shown in FIGS. 11-14 decreases the velocity of the water diverted to the non-surf side, which enables interfering wakes on the surf-side to converge sooner on the surf-side (i.e., converge nearer the transom) to produce a comparatively shorter (in distance), taller (in height) wake than the convergent water channel.

Figure 15:
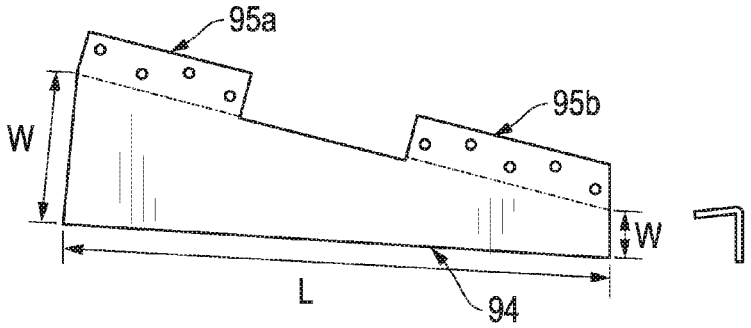
FIG. 15 illustrates top and side views of an angled plate and mounting bracket included within the port side wake-modifying device shown in FIGS. 11 and 13-14.
Figure 16:
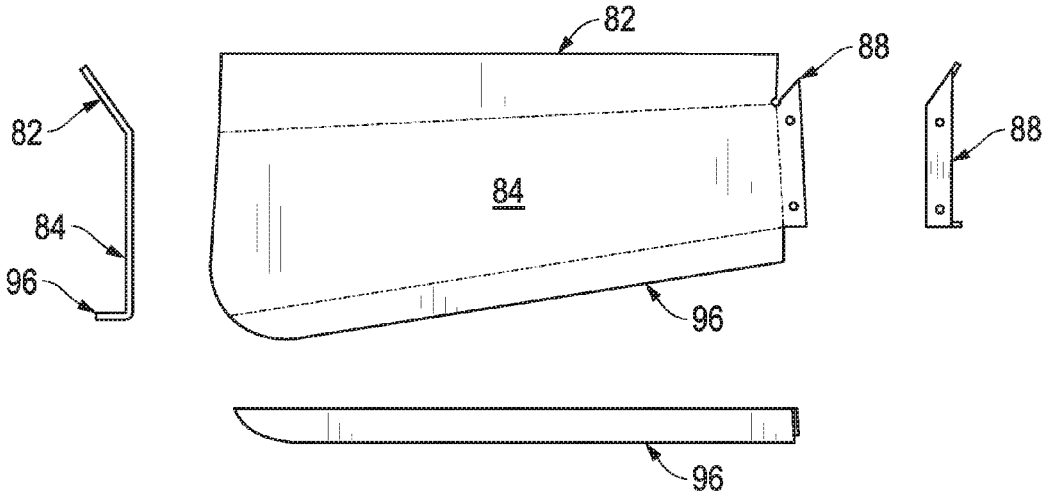
FIG. 16 illustrates top and side views of the water channel included within the port side wake-modifying device shown in FIGS. 11 and 13-14.
Figure 17:
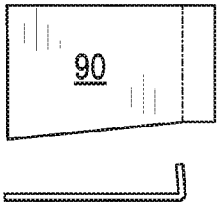
FIG. 17 illustrates top and side views of a wedge that may be included within the port side wake-modifying device shown in FIGS. 11 and 13-14.

FIGS. 15-17 are illustrations of individual components used to form the port side wake-modifying device 80 shown in FIGS. 11 and 13-14, and exemplary dimensions of such components, according to one particular embodiment. The dimensions of the components that form the improved wake-modifying device described herein are not strictly limited to those described below in reference to FIGS. 15-17. These dimensions are purely exemplary and are provided as one example of a best mode for configuring and fabricating the improved port side wake-modifying device 80 shown in FIGS. 11 and 13-14. Similar dimensions may be used to fabricate the starboard side wake-modifying device 100 shown in FIG. 12.

FIG. 15 illustrates top and side views of the angled plate 94 and mounting bracket 95, according to one exemplary embodiment. In the illustrated embodiment, the angled plate 94 has a length (L) of about 19-20 inches and a width (W) that varies from about 1-2 inches at the inboard side to about 5-6 inches at the outboard side of the plate. With this configuration, the angled plate 94 may be configured to rotate the wake-modifying device 80 approximately 15° away from the transom of the boat. Alternative dimensions may be used to rotate the wake-modifying device 80 closer to, or farther away from, the transom of the boat.

The angled plate 94 may be attached to the transom of the boat by any mechanical means, such as by inserting screws through holes formed in the mounting bracket 95 and in the transom. According to one embodiment, the angled plate 94 and mounting bracket 95 may be formed as one integral piece, and the mounting bracket may be formed by bending the mounting bracket portions 95*a*, 95*b* upwards, so that an angle between about 80° and about 100° is formed between the angled plate 94 and the mounting bracket 95. In the embodiment of FIG. 15, the mounting bracket 95 extends upward from the upper surface of the angled plate 94 at an angle of 96°; however, this angle may vary significantly in other embodiments. In the embodiment of FIG. 15, the mounting bracket 95 is illustrated as comprising two portions 95*a* and 95*b*. In alternative embodiments, the mounting bracket 95 may be formed as a singular piece, which extends along the entire forward end of the angled plate 94.

FIG. 16 illustrates top and side views of a divergent water channel formed by the downwardly inclined forward end portion 82, planar upper portion 84, downwardly inclined trailing end portion 96 and inboard sidewall 88. In the illustrated embodiment, the water channel is formed by first cutting a sheet of metal to form the illustrated contour, and then bending portions 82, 88 and 96 down from the planar upper portion 84 by about 35°, about 85° and about 90°, respectfully. In the illustrated embodiment, the length of the water channel is about 19-20 inches, and the width of the water channel varies from about 4-6 inches on the inboard side to about 7-9 inches on the outboard side. The depth of the water channel is about 1-2 inches in the illustrated embodiment.

FIG. 17 illustrates top and side views of a wedge 90, according to one exemplary embodiment. In the illustrated embodiment, wedge 90 is formed by first cutting a sheet of metal to form the illustrated contour, and then bending the inboard edge of the wedge up by about 85° (or some other angle) to match the angle of the inboard sidewall 88 to which the wedge 90 may be subsequently attached. In one embodiment, the wedge 90 may be attached to the inboard sidewall 88 by inserting screws (or some other mechanical fasteners) through the holes formed within the wedge 90 and inboard sidewall 88. Alternatively, the wedge 90 may be attached using some other permanent or non-permanent means to the inboard sidewall 88 and/or to the lower surface of the planar upper portion 84.

In the illustrated embodiment, wedge 90 is an inclined plate formed from a metal or plastic material. Alternatively, wedge 90 could be implemented as a solid wedge, as described above. In the illustrated embodiment, the length of the wedge is about 6 inches, although this length may vary significantly in other embodiments. In some embodiments, the width of the wedge 90 may be consistent and substantially equal to the width ($W_1$) of the planar upper portion 84 on the inboard side (e.g., approximately 4 inches). In other embodiments, the width of the wedge 90 may diverge from about 4 inches on the inboard side to about 5 inches or more on the outboard side following the divergent lines of the planar upper portion 84. If the wake-modifying device is provided with a convergent water channel, the width of the wedge 90 may have a smaller width on the inboard side and a larger width on the outboard side of the wedge.

Various configurations of improved wake-modifying devices have been shown in FIGS. 4-17 and described above. All such configurations provide a water channel and (optional) wedge configured for capturing and redirecting significantly more of the water flowing past the transom than conventional trim tabs consisting primarily of a flat plate. This increases the upward force applied to the deployed wake-modifying device and raises the stern of the boat on the non-surf side to list the boat to the surf side, producing a larger wake on the surf side.

Some configurations provide a convergent water channel (see, FIG. 10), while others provide a divergent water channel (see, FIGS. 5-6 and 11-17). The convergent water channel accelerates the water diverted to the non-surf side, which delays the convergence of constructively interfering wakes on the surf side (i.e., converges further away from the transom) to produce longer, smoother wakes on the surf side of the boat. Compared to the convergent water channel, the divergent water channel produces a comparatively shorter (in distance), taller (in height) wake by decreasing the velocity of the water diverted to the non-surf side, which enables constructively interfering wakes on the surf-side to converge sooner on the surf-side (i.e., converge nearer the transom). As different wake sizes and shapes are often preferred for different water sports and participants, the various configurations described herein provide a plethora of wake-shaping options from which to outfit one's boat.

The various configurations of improved wake-modifying devices described herein may be used to produce a wake of any desirable shape and size for a variety of different water sports, skill levels and preferences. In some embodiments, a particular wake-modifying device may be modified by the consumer to produce a substantially different wake size and/or shape than it was originally intended. For example, any of the wake-modifying devices described herein may be modified to either remove the wedge (68, 90) or replace it with a wedge of substantially different dimensions. In another example, the L-shaped bracket forming the downwardly inclined trailing end portion 86 in FIGS. 8-9 may be repositioned by the consumer to provide a substantially more convergent or divergent water channel, or may be replaced with a larger L-shape bracket to increase the depth of the water channel. Other modifications not specifically mentioned herein may also be apparent to the skilled artisan and may be used to further modify the wake size and/or shape.

It will be appreciated to those skilled in the art having the benefit of this disclosure that this invention is believed to provide improved wake-modifying devices for boats. Further modifications and alternative embodiments of various aspects of the invention will be apparent to those skilled in the art in view of this description. For example, although the description of methods, devices and systems provided herein are specific to configurations for manipulating and enhancing wakes and waves for water sports, the wake-modifying devices provided herein are not necessarily so limited. In particular, the wake-modifying devices considered herein may be designed for manipulating water flow for any desired objective at a stern of a boat. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A wake-modifying device coupled to a transom of a boat near a port side or near a starboard side of a hull of the boat, the wake-modifying device comprising:

a hinge configured to provide a pivot axis about which the wake-modifying device is rotated between a deployed position and a non-deployed position; and a water channel implemented as a concave structure having downwardly curved or inclined forward end and trailing end portions, wherein the water channel is configured to redirect water flowing past the transom out through an outboard side of the water channel when the wake-modifying device is rotated to the deployed position.

2. The wake-modifying device as recited in claim 1, wherein the water channel comprises a convex upper portion, a concave trailing end portion, a planar lower portion and an inboard sidewall, all of which are coupled together or formed in an integral manner to produce the water channel.

3. The wake-modifying device as recited in claim 2, wherein the inboard sidewall is coupled to or formed integral with inboard edges of the convex upper portion, the concave trailing end portion and the planar lower portion to seal off an inboard side of the water channel, and wherein the outboard side of the water channel is left open.

4. The wake-modifying device as recited in claim 2, wherein a majority of a center surface area of the planar lower portion and the concave trailing end portion is missing or removed to create openings in the planar lower portion and the concave trailing end portion.

5. The wake-modifying device as recited in claim 1, wherein the water channel comprises a downwardly inclined planar forward end portion, a planar upper portion, a downwardly inclined planar trailing end portion, and an inboard sidewall, all of which are coupled together or formed in an integral manner to produce the water channel.

6. The wake-modifying device as recited in claim 5, wherein the downwardly inclined planar trailing end portion comprises a substantially L-shaped bracket, which is coupled to a lower surface of the planar upper portion near a trailing end of the planar upper portion, and which extends down from the lower surface of the planar upper portion at an angle ranging between about 80° and about 160°.

7. The wake-modifying device as recited in claim 5, wherein the downwardly inclined planar trailing end portion is formed at a trailing end of the planar upper portion by bending the trailing end downward, so that at an angle ranging between about 80° and about 160° exists between a lower surface of the planar upper portion and the downwardly inclined planar trailing end portion.

8. The wake-modifying device as recited in claim 5, wherein the inboard sidewall is coupled to or formed integral with inboard edges of the downwardly inclined planar forward end portion and the planar upper portion to seal off an inboard side of the water channel, and wherein the outboard side of the water channel is left open.

9. The wake-modifying device as recited in claim 1, wherein a width of the water channel is larger on an inboard side and smaller on the outboard side to produce a convergent water channel.

10. The wake-modifying device as recited in claim 1, wherein a width of the water channel is smaller on an inboard side and larger on the outboard side to produce a divergent water channel.

11. The wake-modifying device as recited in claim 1, wherein a width of the water channel is substantially equal on an inboard side and the outboard side to produce a water channel of substantially consistent width.

12. The wake-modifying device as recited in claim 1, wherein the hinge directly couples the water channel to the transom of the boat.

13. The wake-modifying device as recited in claim 1, wherein the hinge couples the water channel to a trailing end of an angled plate, whose forward end is fixedly attached to the transom of the boat.

14. The wake-modifying device as recited in claim 1, wherein the hinge couples a forward end of an angled plate to the transom of the boat, and wherein the water channel is coupled to an opposite, trailing end of the angled plate, such that when the wake-modifying device is rotated between the deployed position and the non-deployed position, the angled plate rotates about the pivot axis along with the water channel.

15. The wake-modifying device as recited in claim 1, further comprising a linear actuator coupled between the transom of the boat and the wake-modifying device for moving the wake-modifying device from the non-deployed position and the deployed position, and vice versa.

16. The wake-modifying device as recited in claim 1, further comprising a wedge coupled within, and to an inboard side of, the water channel to redirect substantially more water out through the outboard side.

17. The wake-modifying device as recited in claim 16, wherein the wedge comprises a length ranging between about 4 inches and about 15 inches, and an angle of inclination ranging between about 3° and about 50°.

18. The wake-modifying device as recited in claim 16, wherein the wedge is permanently attached to an inside surface of the water channel at the inboard side of the water channel.

19. The wake-modifying device as recited in claim 16, wherein the wedge is attached to an inside surface of the water channel at the inboard side of the water channel by mechanical fasteners, which enable the wedge to be removed.

20. The wake-modifying device as recited in claim 16, wherein the wedge is an inclined plate formed from a metal, plastic or fiberglass material.

21. The wake-modifying device as recited in claim 16, wherein the wedge is a solid wedge formed from a metal, plastic or fiberglass material.

22. A boat, comprising:

a hull having a port side, a starboard side and a transom; and a pair of wake-modifying devices coupled to the transom, one near the port side and one near the starboard side, wherein each wake-modifying device comprises:

a hinge configured to provide a pivot axis about which the wake-modifying device is rotated between a deployed position and a non-deployed position; and a water channel implemented as a concave structure having downwardly curved or inclined forward end and trailing end portions, wherein the water channel is configured to redirect water flowing past the transom out through an outboard side of the water channel when the wake-modifying device is rotated to the deployed position.

23. The boat as recited in claim 22, wherein the wake-modifying device further comprises a wedge coupled within, and to an inboard side of, the water channel to redirect substantially more water out through the outboard side.

* * * * *